United States Patent [19]

Youtz

[11] Patent Number: 4,832,594

[45] Date of Patent: May 23, 1989

[54] CONTROL SYSTEM WITH TIMER REDUNDANCY

[75] Inventor: Stephen E. Youtz, Wayne, Ind.

[73] Assignee: Hamilton Standard Controls, Inc., Farmington, Conn.

[21] Appl. No.: 95,505

[22] Filed: Sep. 10, 1987

[51] Int. Cl.[4] ..... F23N 5/20; F23N 5/24

[52] U.S. Cl. ..... 431/16; 431/24

[58] Field of Search ..... 431/24, 26, 16, 27

[56] References Cited

U.S. PATENT DOCUMENTS

| | | | |
|---|---|---|---|
| 4,239,478 | 12/1980 | Tanaka et al. | 431/24 |
| 4,319,873 | 3/1982 | Michaud et al. | 431/24 |
| 4,384,844 | 5/1983 | Yamamoto et al. | 431/24 |
| 4,384,845 | 5/1983 | Hinton et al. | 431/26 |
| 4,445,841 | 5/1984 | Tanaka et al. | 431/27 |
| 4,518,345 | 5/1985 | Mueller et al. | 431/24 |
| 4,605,863 | 8/1986 | Toudo et al. | 431/24 X |
| 4,695,246 | 9/1987 | Beilfuss et al. | 431/31 |

*Primary Examiner*—Samuel Scott
*Assistant Examiner*—Carl D. Price

[57] ABSTRACT

A fail safe control circuit for supplying gas to a burner is disclosed and includes a plurality of timers, two of which set upper and lower bounds on a window or acceptable time interval during which a third timer must issue a control signal for that signal to be valid. The timers are operated from at least two different sources of timing signals so that a failure of either source of timing signals as well as a malfunction of any one of the three timers will result in an invalid control signal and the control will lock out to preclude burner operation.

4 Claims, 3 Drawing Sheets

CONTROL SYSTEM WITH TIMER REDUNDANCY

SUMMARY OF THE INVENTION

The present invention relates generally to electronic controls for burners, furnaces and the like, and more particularly to a multiplicity of timing circuits operable together to confirm proper timing of the burner controls. The invention finds utility in an integrated control for such burners in the illustrative environment of a gas-fired furnace or may be implemented in a control system where discrete functions are controlled by discrete components.

Older furnace control systems have taken a modular approach with separate controls for functions such as gas ignition, a blower fan, the gas valve or valves, induced draft sensing, and thermostat setback operations. The integrated furnace control has taken many of the furnace control functions and combined them into one main control module. Other functions may also be incorporated into the control module such as a thermostat setback function. The combining of all these functions into one complete module has made the system more cost effective than using separate components, allows manay additional features, and provides a safer control.

The timing of various operations in furnace control of either the discrete or integrated type is critical to proper operation. In U.S. Pat. No. 4,239,478 there is disclosed a combustion control circuit having a pair of conventional timers, one for controls and the other a so-called safety timer for stopping operation in the event firing does not take place within a predetermined time after initiation of the ignition sequence. This patented device adds several gates to conventional circuitry to check for proper operation of the safety timer. Two separate timing circuits in a fuel ignition system are also disclosed in U.S. Pat. No. 4,384,845, but in this patented arrangement, the timers each control certain of the components and fail to confirm proper operation of one another.

In one embodiment, the present invention uses both software and hardware timers to verify the accurate execution of software code. This technique is an improvement over the schemes in the above prior patents and an improvement over the "watchdog" timer circuit. The use of a "watchdog" circuit in the microprocessor art is well known and requires the software to toggle the input of the circuit before the circuit times out. Upon timing out, the circuit sends a reset signal to the microprocessor which starts the software code from the beginning. Such a feature in a gas control circuit is not the safest because, if the software has a problem that consistently causes the watchdog to reset the microprocessor, the problem will never get fixed leaving the control operating in a possible unsafe condition.

Software timing in relation to proper code execution is much more reliable than strobing the input to a watchdog timer circuit. The few instructions required to strobe the circuit can be executed without the need of any other part of the code being correct. The possibility of every watchdog strobe being made while having bad code is remote, but the possibility of three timers always being within their given windows is much more remote and essentially impossible. Watchdog circuits can also have reliability problems because of the number of hardware components involved.

In copending applications Ser. No. 07/095,508 (assignee docket number HCI-311-ES) and Ser. No. 07/095,506 (assignee docket number HCI-319-ES) each assigned to the assignee of the present application, entitled INTEGRATED FURNACE CONTROL AND CONTROL SELF TEST in the names of Mierzwinski, Grunden and Youtz and INTEGRATED FURNACE CONTROL HAVING IGNITION AND PRESSURE SWITCH DIAGNOSTICS in the names of Grunden, Youtz and Mierzwinski respectively, each filed on even date herewith, there are disclosed companion integrated furnace control systems sharing many features and adapted to incorporation of the present invention. The entire disclosures of those applications is specifically incorporated herein by reference.

The concepts of the present invention may be incorporated into such integrated furnace control systems either by preprogramming the microprocessor which forms the nucleus of such systems or by a combination of preprogramming and separate hardware components. The concepts may also be implemented in either discrete type or integrated control systems in the form of supplementary circuitry.

Among the several objects of the present invention may be noted the provision of a versatile and economical integrated furnace control system of enhanced safety; the provision of a furnace control system which is timed using three separate timers to provide a redundant safety feature; the provision of redundant timing schemes within a furnace control to enhance fail safe operation; the provision of a burner control system having multiple timers all of which must operate within a prescribed time frame to ensure safe operation; the provision of a burner control in accordance with the previous object which locks out to preclude burner operation if a timing function deviates from the prescribed time frame; and the enhancement of overall safety in a fuel burner. These as well as other objects and advantageous features of the present invention will be in part apparent and in part pointed out hereinafter.

In general, an integrated burner control for a gas burner of the type having at least one gas valve control relay which is operable upon command from a microprocessor in the integrated burner control to open a gas valve and supply gas to a burner combustion chamber has first, second and third timers. The first and second timers are adapted to define an acceptable time interval during which the third timer may validly issue a control signal. The control is responsive to the occurrence of the control signal outside the acceptable time interval for precluding operation of the gas valve control relay.

Also in general, and in one form of the invention, a circuit for measuring a selected time interval and for issuing an output at the expiration of that selected time interval has a first counter preset to a count corresponding to the selected time interval and a second counter preset to a count which exceeds the first count by a fixed amount. Timing pulses decrement the first and second counters. The counters provide a first output signal when the first counter is decremented to zero and a second output signal when the second counter is decremented to one. A third counter is preset to zero and adapted to increment up to a count corresponding to the selected time interval and upon reaching that count, the third counter provides a third output signal. The circuit is responsive to the first, second and third output signals for issuing the output indicative of the expiration of the selected time interval only if the third output signal occurs within the time between the first and second output signals. Thus, a window is created by the first and second counters within which the third counter must issue its command if that command is to be considered valid. The circuit further includes a first source of timing pulses for decrementing the first counter and for decrementing the second counter, and a second source of timing pulses for incrementing the third counter along with an alarm for issuing a signal indicative of possible malfunction when the third signal occurs outside the time interval between the first and second signals. The malfunction could be an error in either of the timing sources or a fault in any one of the counters. Thus, proper operation of the timing sources and of the counters is confirmed before the output indicative of the expiration of the selected time interval is issued.

Still further in general, a timer circuit which receives incrementing pulses from a clock and issues an output signal a selectable time after receipt of an initiating signal is backed-up by a first auxiliary timing circuit which defines an acceptable lower bound on the time of occurrence of the timer output signal, and a second timing circuit which defines an acceptable upper bound on the time of occurrence of the timer output signal. Further circuitry is responsive to the timer and to the first and second auxiliary timing circuits for transmitting the timer output signal only if the timer output signal occurs between the acceptable bounds. The first and second timing circuits are preset to separate values near a value representing the selected time, and an auxiliary cock supplies decrementing signals to the first and second auxiliary timing circuits. The further circuitry transmists the timer output signal only if one auxiliary timing circuit has been decremented to a zero value and the other auxiliary timing circuit has been decremented to a specified non-zero value.

The exemplifications set out herein illustrate a preferred embodiment of the invention in one form thereof and such exemplifications are not to be construed as limiting the scope of the disclosure or the sceop of the invention in any manner.

DESCRIPTION OF THE PREFERRED EMBODIMENT

In the lastmentioned above identified copending application there is disclosed an integrated furnace control illustrating one environment in which the present invention may be used. In that system, the control incorporates a self-test feature which shuts down the furnace in the event of any one of a number of possible sensed faults. Self-testing occurs automatically before an attempt at ignition and during furnace operation. Proper functioning of the sensor which senses for induced air flow through the burner combustion chamber is tested prior to enabling a fan which causes that induced air flow. Air flow is confirmed by sending to and receiving back from the sensor a sequence of pulses. Should air flow not be sensed during a combustion period, combustion is terminated. A flame sensor is provided for determining the presence of a flame in the combustion chamber. During times when a flame should be present, pulse sequences are sent to and received back from the flame sensor to confirm that a flame is present. When it is known that no flame is present, if sent pulses are received back, a fault has occurred and the system locks out. If, at any time, any pulses are received when none were sent the system also locks out. At an appropriate time in the sequence of operations, an igniter is enabled for a selected time interval. The igniter and the gas valve are timed using three separate timers, one primary timer and two secondary timers. The redundant safety features of these timers is provided by the present inventive technique. The main timer is a down counter and is referenced to a line synchronization interrupt line. The first backup timer is also a down counter referenced to this same line, however, it is offset from the primary timer by one count. The second backup timer is an up counter referenced to the microprocessor internal clock. Timing is considered valid when the backup timers are within certain windows relative to the primary timer. If the timers are out of synchronization, the control goes into a lockout mode. The purge timer which, at a prescribed time, operates the inducer fan for a preset period of time may operate in this same redundant manner as may other functions which require a pause in operation or execution of a specified operation for a selected time interval.

Figure 3:
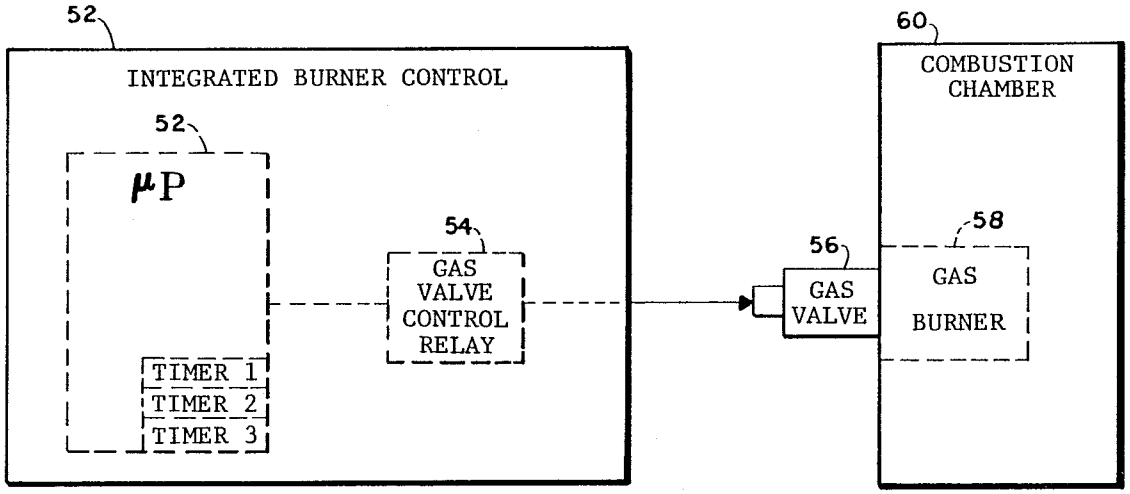

Referring first to FIG. 3, relevant portions of the integrated furnace control described in the previous paragraph and incorporating the present invention are depicted in very general block diagram form. The integrated burner control 50 is depicted as including, amongst other things, a micrprocessor 52 also shown as including timing capabilities represented by Timer 1, Timer 2 and Timer 3. Timers 1, 2 and 3 may typically be provided by three counters or registers which are stepped by appropriate clocking or timing pulses. The microprocessor 52 is operative to provide various enabling and/or disabling control signals to various loads, including the gas value control relay 54. Relay 54 then operates electricaly to actuate/deactuate the gas value 56 associated with gas burner 58 in combustion chamber 60.

Figure 1:
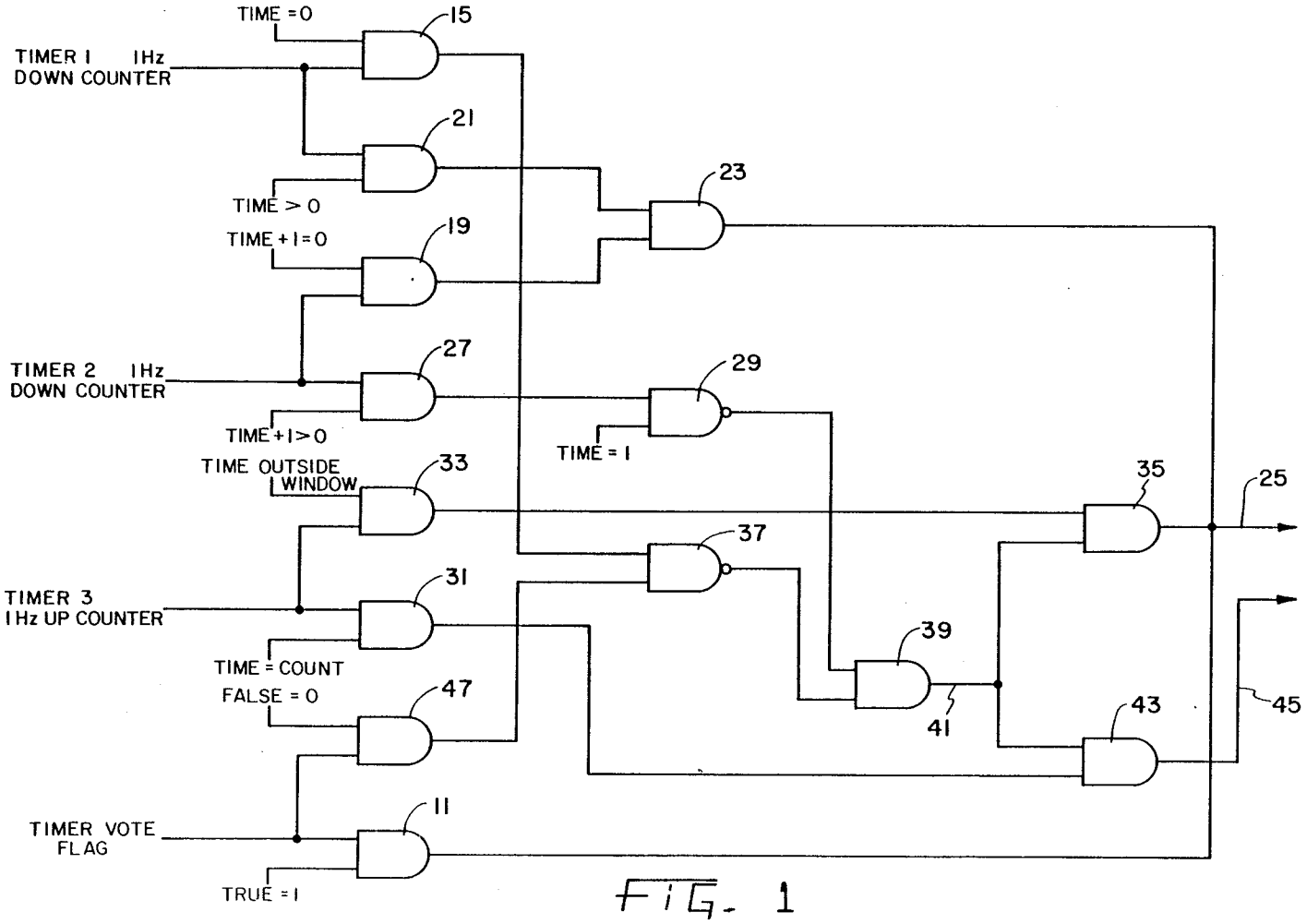
FIG. 1 illustrated, in block diagram form, logic circuitry symbolically representing the invention in one form.
Figure 2:
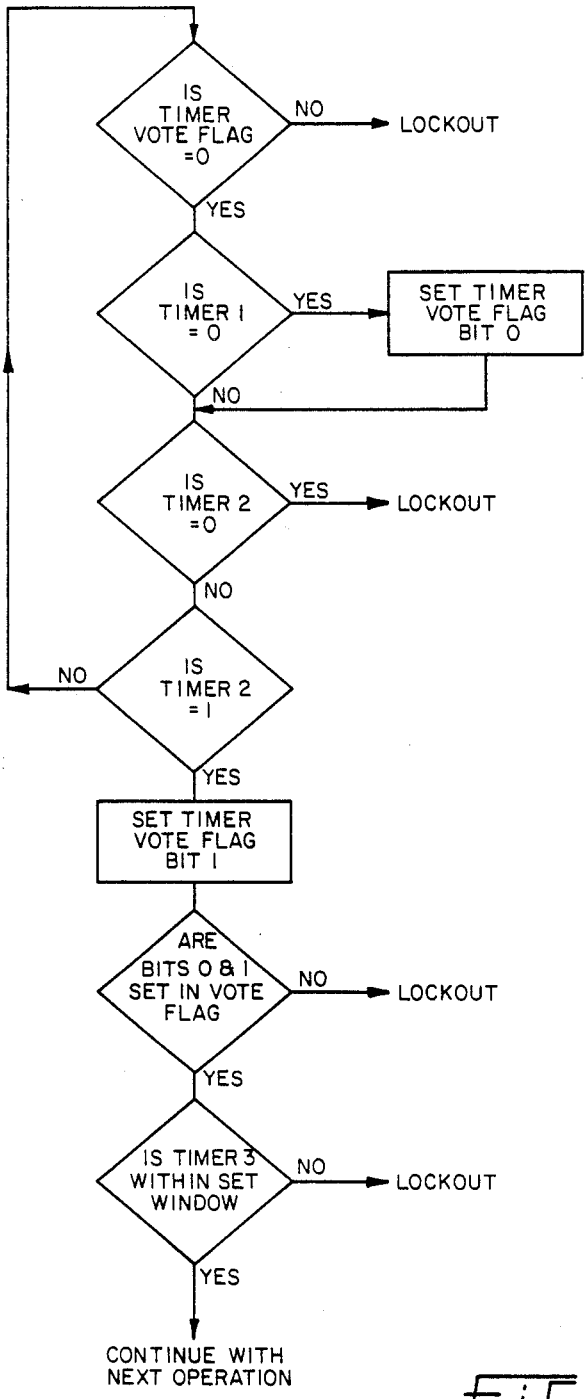
FIG. 2 is a system logic flow diagram illustrating the present invention and FIG. 3 is a generalized block diagram of the integrated burner control incorporating the invention.

Comparing the circuit of FIG. 1 with the logic diagram of FIG. 2, the desired time is loaded into timer 1 and the desired time plus one is loaded into timer 2. Timer 3 is reset to zero and the vote flag is cleared as the initial steps in a countdown subroutine. Timers 1 and 2 are essentially counters which receive one Hertz decrementing pulses, while timer 3 is a counter intiially set to zero and incremented by one Hertz incrementing pulses. The circuit of FIG. 1 operates once each pulse or cycle count. While many conventions are possible, in the following description, the convention of a gate being high or enabled is taken to be a one or yes output from that gate for illustrative purposes. If the vote flag is set (a one or on), AND gate 11 sends a signal on line 25 to lockout the system. Otherwise, AND gate 15 determines if timer 1 has decremented to zero and if it has, sets the vote flag to zero. A zero vote flag corresponds to a "one" output from AND gate 47. If timer 1 has not decremented to zero (a high or yes signal from AND gate 21), timer 2 is checked to see if it has erroneously decremented to zero (a yes or "one" from AND gate 19). If it has, both inputs to AND gate 23 are high, a lockout signal appears on line 25 and the system again locks out. If instead timer 2 has decremented to one, AND gate 27 driving NAND gate 29 sets the timer vote flag to one. Timer 3 is checked to see if its count is within the window and if it is, AND gate 31 is enabled, otherwise, AND gate 33 provides an output to one input of AND gate 35. If the vote flag is not set (as indicated by AND gate 47) and the timer 1 has reached zero, the outputs and NAND gate 37 and NAND gate 29 are combined in AND gate 39 to provide a signal on line 41 indicating that both timers 1 and 2 have operated properly. If timer 3 has a count within the designated window, AND gate 43 provides an output on line 45 indicating that the next operation should now commence or that the prescribed time interval has expired.

The selection of which counter is incremented and which is decremented as well as which timing pulse sources are used is a matter of choice. The embodiment illustrated in FIG. 1 uses the sixty Hertz line interrupt for decrementing timers 1 and 2 while a 3360 Hertz internal timer interrupt is appropriately divided down and then used to increment timer 3.

In one embodiment of the invention, the first timer is an up counter controlled by the external processor interrupt which is exercised sixty times each second from line voltage. This provides an accurate timing base, but can vary slightly with variations in line voltage. The second timer is also an up counter, but is exercised by a software interrupt based on the microprocessor oscillator. The second timer is compared to the first timer each time a decision is to be made and if the differene between the timers is within a given window, the timing is considered correct as is the software code. The third timer is a down counter exercised by the software interrupt which was used for the second timer. For a valid timing output signal, the third timer output must also be within a given window at the same time the first two timer outputs are within their given window.

The windows are based on the frequency at which the microprocessor is run and temperature. Temperature plays an important role in the stability of timing since the microprocessor oscillator may be controlled by, among other things, a resistor. The window allows for instability of the hardware without effecting the code execution.

From the foregoing, it is now apparent that a novel redundant timer arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. In an integrated burner control for a gas burner of the type having at least one gas valve control relay operable upon command from a microprocessor in the integrated burner control to open a gas value and supply gas to a burner combustion chamber, the improvement comprising first, second and third timers, the first and second timers adapted to define an acceptable time interval during which the third timer may validly issue a control signal, a first source of timing pulses operatively connected to step two of said first, second and third timers, a second source of timing pulses operatively connected to step the remaining one of said first, second and third timers, and means responsive to the occurrence of the control signal outside the acceptable time interval for precluding operation of the gas value control relay.

2. The combination of claim 1 wherein said first timer comprises a first counter preset to a count corresponding to a selected time interval and means for decrementing the first counter and for providing a first signal when the first counter is decremented to zero;

said second timer comprises a second counter preset to a count which exceeds the count corresponding to the selected time interval by a fixed amount and means for decrementing the second counter and for providing a second signal when the second counter is decremented to a count which exceeds zero by the fixed amount; and said third timer comprises a third counter preset to zero and adapted to increment to a count corresponding to the selected time interval and upon reaching that count, to provide a third output signal, and means responsive to the first, second and third output signal for issuing the output indicative of the expiration of the selected time interval only if the third output signal occurs within time between the first and second output signals.

3. The combination of claim 2 wherein said first source of timing pulses is supplied to the means for decrementing the first counter and to the means for decrementing the second counter, and said second source of timing pulses being connected for incrementing the third counter.

4. The combination of claim 3 further comprising alarm means for issuing a signal indicative of possible malfunction when the thrid signal occurs outside the time interval between the first and second signals.

* * * * *